United States Patent [19]

Schenkel

[11] 4,311,916

[45] Jan. 19, 1982

[54] TRAVELLING SCANNING APPARATUS FOR SUCCESSIVELY SCANNING THE WORKING CONDITIONS AT EACH SPINNING POSITION OF A RING SPINNING MACHINE

[75] Inventor: Eduard Schenkel, Seuzach, Switzerland

[73] Assignee: Rieter Machine Works Ltd., Winterthur, Switzerland

[21] Appl. No.: 130,822

[22] Filed: Mar. 17, 1980

[30] Foreign Application Priority Data

Mar. 27, 1979 [CH] Switzerland ..... 28201/79

[51] Int. Cl.[3] ..... G01N 21/86

[52] U.S. Cl. ..... 250/561; 57/81

[58] Field of Search ..... 250/561, 234, 222; 57/81, 264, 305; 356/429, 430, 431

[56] References Cited

U.S. PATENT DOCUMENTS 3,992,865 11/1976 Tuchida et al. ..... 57/81

4,137,699 2/1979 Stahlecker et al. ..... 57/264

4,186,309 1/1980 Gnuechtel ..... 250/561

*Primary Examiner*—David C. Nelms

*Attorney, Agent, or Firm*—Werner W. Kleeman

[57] ABSTRACT

A travelling scanning apparatus for successively checking the working conditions at the spinning position of a ring spinning machine is enabled, in order to determine whether a yarn breakage has occurred at a spinning position, and, in the affirmative case, whether there prevails a danger of damage due to lap-up formation on a roll of the drafting arrangement. Using a yarn feeler first the presence of a normally spun yarn is detected. If no yarn is present, the broken yarn suction nozzle, which is used for eliminating the fibres not spun in, is lowered from its normal working position into a scanning position, and an optimum fibre stream is obtained between the delivery rolls of the drafting arrangement and the lowered nozzle for scanning using a second feeler. In case of non-presence of this fibre stream, that is in case possible lap-up formation, a roving supply interrupting device is activated and the roving supply to the drafting arrangement is interrupted.

12 Claims, 9 Drawing Figures

TRAVELLING SCANNING APPARATUS FOR SUCCESSIVELY SCANNING THE WORKING CONDITIONS AT EACH SPINNING POSITION OF A RING SPINNING MACHINE

BACKGROUND OF THE INVENTION

The present invention concerns a travelling scanning apparatus for successively scanning the working conditions at each spinning position of a ring spinning machine with respect to end breakages, as well as to lap-up formations on drafting arrangement rolls.

Generally speaking, the travelling scanning apparatus is of the type comprising a yarn feeler checking the presence of a yarn between the delivery rolls of the drafting arrangement and the spindle without contacting the yarn. There is provided a second feeler which, in the event a yarn breakage which is detected, checks the presence of a fibre stream between the delivery rolls of the drafting arrangement and a broken yarn suction nozzle arranged directly below the bottom delivery roll in its normal working position. In order to detect the fibre stream, the fibre stream is deflected by a fibre stream deflecting device. An activating device, in the event of absence of a fibre stream, serves to activate an interrupting device interrupting the roving supply and which is provided at each spinning position of the ring spinning machine.

A ring spinning machine for the final spinning of the yarn comprises a large number of spinning positions, more than 400 as a rule, each position of which comprises a drafting arrangement in which the supplied fibre arrangement (also called roving) is drafted to the desired fineness and subsequently is twisted and spun into a yarn and wound up using a ring and spindle arrangement.

Notwithstanding continued efforts, there cannot be avoided the occasional occurrence of a yarn breakage between the drafting arrangement and the spindle at a spinning position of the ring spinning machine. This relatively rare event is very annoying in a spinning mill operation, as it involves loss of production and additional work. Furthermore, a loss of material is caused, as the loose fibres still emerging from the pair of delivery rolls of the drafting arrangement, which continues to operate, are no longer spun-in but are transferred to a collector via a suction nozzle of a broken yarn suction device.

Time and again it happens that these fibres do not move into the suction nozzle but lap-up about one or both delivery rolls. Such fibre lap-up increases in size as long as the fibre supply is not interrupted or the yarn formation is not resumed again, until finally the drafting arrangement of the spinning position concerned is damaged. It thus is important in the spinning mill operation to have the working conditions of the ring spinning machine scanned by the operating personnel and to have the broken ends pieced up, in which process any fibre lap-ups built up on the rolls are to be first eliminated.

Devices have become known recently, the object of which is the replacement of the ring spinning operators by automatic devices, namely by operating devices or scanning devices performing the following tasks:

(a) Recoginizing the working conditions at the spinning position, i.e. for instance, detection of a yarn formation, the presence of a fibre lap-up on the rolls of the drafting arrangement or of a roving at the entrance of the drafting arrangement.

(b) Performing an actual operation at the spinning position, such as e.g. piecing the broken yarn, or stopping the supply of fibre material to the drafting arrangement.

Such operations are effected in dependence upon the recognized working conditions at the spinning position.

The present invention concerns the recognition of certain working conditions at the spinning position and the performance of a certain operation, namely the interruption of the material supply, in the event the danger of lap-up formation on a delivery roll of the drafting arrangement is detected.

Various solutions for this task have become known already.

Thus, it is known from Swiss Patent No. 571,588 (or German Patent Publication No. 2,339,654) for automatically piecing yarns on ring-spinning machines, that by using a scanning device the absence of the yarn as well as a lap-up on the delivery rolls is simultaneously detected. In this arrangement a light source is directed at the path of the strand of fibres emerging from the delivery rolls but not spun into a yarn, which strand reflects the light beam onto a photocell. With this proposed equipment there is relied on the fact that the path of the strand of fibres subject to the spinning-in process does not coincide with the path of the strand of fibres which no longer is spun-in and is sucked off via the fixedly located suction nozzle, but differs by a distance of the order of a few millimeters.

Travelling scanning devices of this type present the disadvantage that the optical scanning of the strand of fibres not spun-in, which flows to the suction nozzle as a stream of fibres, when using a light beam proves unreliable, as the path of the fibre stream suitable for scanning is very short. The suction nozzle of the broken yarn suction device (for ensuring the efficiency of the broken yarn suction action) must be located in the immediate vicinity of the nip of the delivery rolls, such that the deviation of the path as such is already very small. Due to the short scanning path available the reliability of the photocell is also rendered problematic, since the light beam, even in the absence of the strand of fibres, and particularly if the fibres lap-up about one of the delivery rolls, can be reflected by unintended reflecting surfaces (such as e.g. the surface of a fibre lap-up, the surface of the bottom delivery roll or the suction nozzle). Reliable detection of the working conditions prevailing at the spinning position, thus is not ensured. Furthermore, the known travelling device is associated with the disadvantage that very precise guidance of the device along the ring spinning machine is required, as the distance between the two paths mentioned for the strand of fibres is very small. Such precise guide arrangements imply considerable mechanical efforts.

Furthermore, from Swiss Pat. No. 578,059 there is known to the art a travelling scanning device for an automatic yarn piecing device for ring spinning machines, which among other components also comprises a device for the detection of fibre lap-up on the delivery rolls of the drafting arrangement. It consists of two wheels provided with axial openings, these wheels being installed in close vicinity to the periphery of the delivery rolls. If a fibre lap-up builds up, the wheel contacting the lap-up is set into rotation, which phenomenon is scanned optically. Instead of optical scanning also a contacting tongue is proposed for the metallic bottom delivery roll.

Mechanical scanning of the delivery roll also presents the disadvantage that there is required a very precise and expensive guiding arrangement for guiding the scanning device along the machine; its design also is relatively complicated, which adversely influences its price and its reliability.

Furthermore, from a not pre-published Swiss Application Ser. No. 10164/72 there has become known a scanning device of the type initially mentioned, in which there is provided a fibre stream deflection device. The fibre stream deflection or deflecting device serves the purpose of taking-up, in the case of a yarn breakage and controlled by a yarn detector, the fibre stream emerging from the drafting arrangement and carried by the suction air stream, by sucking it off and guiding it to a fibre detector.

This known scanning device has the disadvantage that a travelling suction source is required, which renders the device complicated and expensive.

SUMMARY OF THE INVENTION

It thus is an important object of the present invention to eliminate the disadvantages mentioned with respect to the known scanning devices of the type mentioned initially and to propose a scanning apparatus in which:

(a) the presence of a fibre stream between the delivery rolls of the drafting arrangement and the broken yarn suction nozzle in case of yarn breakage is reliably detected;

(b) the function of the apparatus is substantially independent of its positioning along the machine, in such manner that no excessive requirements are imposed as to the precision of the guide arrangement for the apparatus;

(c) the apparatus does not interfere in any manner with the function of the correctly operating spindle and functions without application of air streams; and (d) the apparatus is simple and economically feasible and does not demand much operating and maintenance labor.

These objectives and others which will become apparent as the description proceeds, are achieved with a scanning apparatus of the type initially mentioned in that, according to the invention, the broken yarn suction nozzle is lowered from its normal working position, by the fibre stream deflecting device activated by the scanning apparatus, to a scanning position sufficiently spaced from the bottom delivery roll for detecting the fibre stream without contacting it, and the second feeler comprises a beam or ray source, which emits a beam onto the deflected fibre stream, and a beam or ray receiver, which receives the signal influenced by the fibre stream.

The lowering of the broken yarn suction nozzle importantly creates optimum working conditions for the contact-free detection action of the second feeler, since in the detection zone a space is freed in which only the fibre stream to be detected can be present. The beam emitted from the beam or ray source thus can be influenced only by the fibre stream which is possibly present. The features of the invention described heretofore ensure that there is achieved the reliability required for a scanning apparatus of this type.

Owing to the correct working conditions thus created, which require no excessively sharp focussing of the beam or ray on the fibre stream to be detected, also part (b) of the preceding object is fulfilled. The aforediscussed features of the invention enable fulfillment of the object of the invention previously described, especially parts (c) and (d) thereof.

According to further aspects of the invention, which are of importance in realizing the objectives of the invention, particularly in respect of part (d) thereof, the fibre stream deflecting device comprises a sliding member which is slideably guided in the scanning apparatus for movement in a direction transverse to the travelling direction of the scanning apparatus. The front part of the fibre stream deflecting device which faces the spinning positions of the ring spinning machine is provided with a guide or guiding slot. During the transverse movement of the sliding member there protrudes into such guiding slot a cam which is rigidly connected with the broken yarn suction nozzle. The guiding slot has such a shape or configuration that owing to the further transverse movement of the sliding member the broken yarn suction nozzle together with the cam are shifted from their normal position into the scanning position. The second feeler is advantageously mounted on the sliding member. Also the activating device is mounted on the sliding member, and further, the activation of the roving supply interruption or interrupting device of the relevant spinning position is effectuated only after the scanning position of the broken yarn suction nozzle by continuing transverse movement of the sliding member. Means serve for moving the sliding member in a first phase to such an extent that the broken yarn suction nozzle is shifted from its normal position into the scanning position, whereas in the second phase of the movement there is effected activation of the roving supply interrupting device. There is also provided a control device for the transverse movement of the sliding member. This control device effects the second phase of movement if the second feeler detects absence of a fibre stream between the delivery rolls of the drafting arrangement and the broken yarn suction nozzle.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figures 1, 1A:
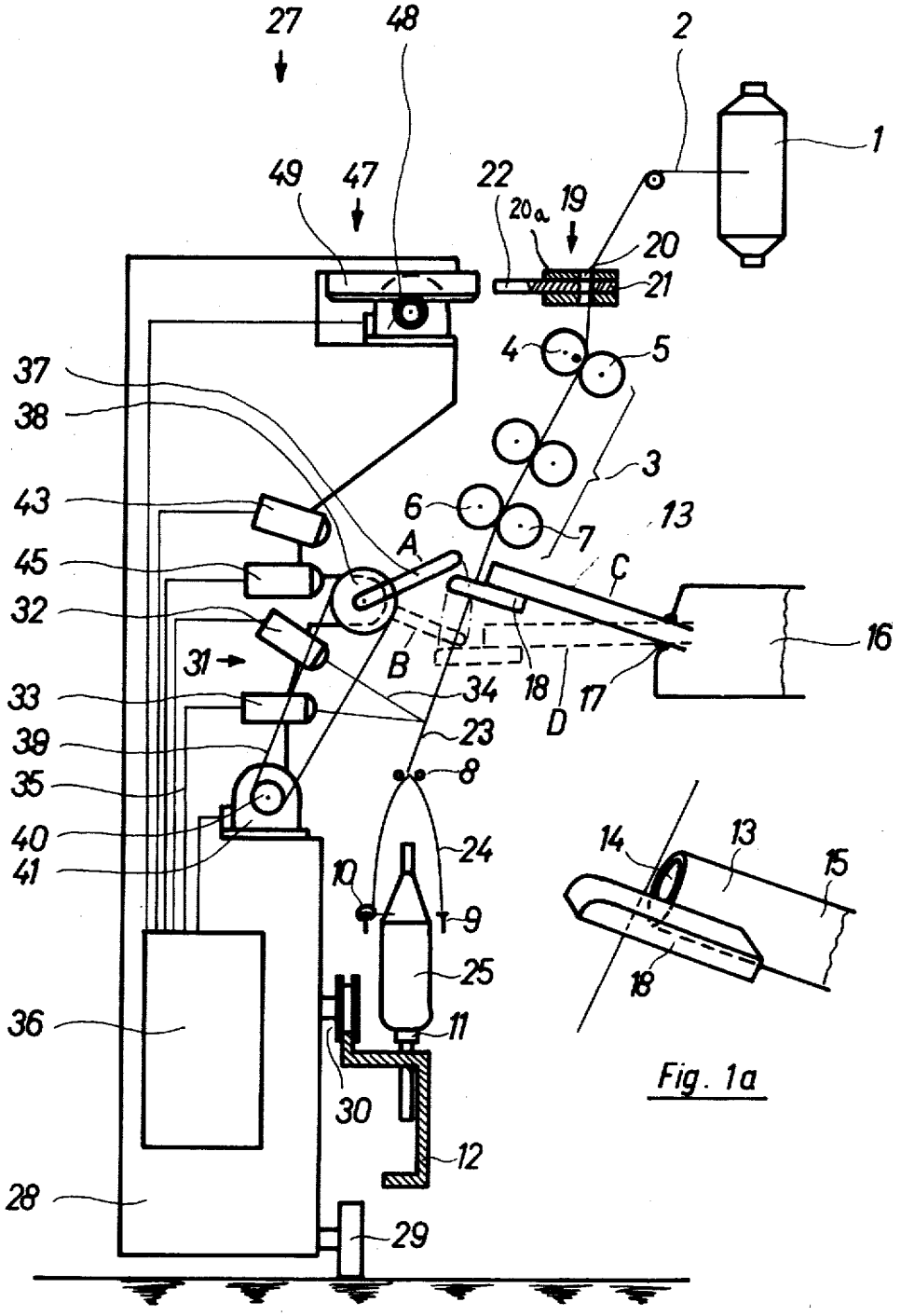
FIG. 1 is a simplified and schematic view of a scanning apparatus according to the invention shown in cross-section as seen along the longitudinal axis of the ring spinning machine.
FIG. 1*a* is a detail according to FIG. 1 in an enlarged axonometric view.

Describing now the drawings, and turning attention to FIG. 1, a roving bobbin 1 rotatably supported in a creel (not shown) delivers a roving 2 for supplying a spinning position. The spinning position substantially comprises a drafting arrangement 3 containing a pair of take-in or infeed rolls 4, 5 and a pair of delivery rolls 6, 7, a thread guide eyelet 8 and a combination of a conventional ring 9, a traveller 10 and a spindle 11. The spindle 11 is rotatably supported in a spindle rail 12 extending over the entire length of the ring spinning machine and is rotated by any suitable standard drive means. Also the bottom rolls 5 and 7 of the drafting arrangement 3 as a rule are designed as metal cylinders extending over the whole length of the machine, whereas the corresponding top rolls 4 and 6 in most cases are designed as so-called tandem pressure rolls (for two neighboring spinning positions) which are biased or pressed against the corresponding rolls 5 and 7 respectively, by conventional means not here shown as the same are unimportant in terms of the invention disclosed herein.

At the exit or outfeed side of the pair of delivery rolls 6, 7 there is provided a broken yarn suction nozzle 13 (see also FIG. 1*a*), which, as shown in FIGS. 1 and 1*a* is formed by the orifice or mouth 14 of a suction tube 15 or equivalent structure. The tubular shape of the broken yarn suction nozzle or device 13 as here shown, also known in practical use as an individual suction device, however, is not the only type of suction device to be considered for use within the scope of the present invention; thus also a flute-type suction tube, known as such, extending over a plurality of neighboring spinning positions and provided with one suction nozzle per spinning position, can be utilized and equivalent or comparable suction devices.

The suction tube 15 is hingedly connected or linked to a longitudinal duct 16 arranged inside the ring spinning machine, within which vacuum conditions prevail. The hinge connection can be established by using a rubber sleeve 17, in such a manner that the orifice or mouth 14 is adjustably movable in elevation. The nozzle 13 exerts a suction action during the entire operating time of the machine.

The suction tube 15 of the yarn suction device 13 supports on its front portion a laterally arranged protruding member or extension 18 (FIG. 1*a*) which extends over the orifice 14, and the function of which is described more fully hereinafter.

Furthermore, a roving supply interrupting device 19 is provided at each spinning position, which is located upstream as seen in the direction of movement of the roving 2 from the pair of takein rolls 4, 5. This roving supply interrupting device 19 can be activated from the outside by the travelling scanning or monitoring apparatus, to be described more fully later on, for the purpose of effecting the controlled interruption of the supply of roving 2 to the drafting arrangement 3. The roving supply interrupting device 19 of the ring spinning machine shown in FIG. 1 consists, for instance, of a bore 20 formed in elements 20*a*, through which the roving 2 passes, and a closure slide or baffle 21 by means of which the bore 20 can be closed. The baffle or slide 21 is connected to an activating rod 22, by means of which the baffle 21 can be activated from outside the machine. Of course, also other roving supply interrupting devices can be equally utilized within the scope of the present invention (compare FIGS. 4 through 6).

During normal operation of a spinning position of such type the roving 2 is taken-off the roving bobbin 1 during such time as the pair of take-in rolls 4, 5 rotates. In the drafting arrangement 3 the roving 2 is drafted according to requirements, in such a manner that a thin strand of fibres (compare also FIGS. 2 and 3) emerges from the pair of delivery rolls 6, 7, which strand is twisted and spun into the final yarn 23. The yarn 23 passes through the thread guide eyelet 8 and under formation of a balloon is wound onto the yarn bobbin package 25 which is supported on the spindle 11 and rotates therewith.

If a yarn breakage occurs, the strand of fibres 26 (FIG. 2) which no longer is spun-in, but still emerging from the delivery rolls 6, 7, is sucked-off immediately by the broken yarn suction nozzle 13 and eliminated. For this purpose, however, the suction nozzle 13 (FIG. 2) must be located at the immediate vicinity of the point x from which the strand 26 emerges (i.e. at the region of the nip line of the rolls 6, 7) since the zone of influence or range of action of a suction of this type is maintained very small for econominal and technological reasons. The fibre material sucked-off via the broken yarn suction nozzle 13 is considered as waste of low value, and thus its quantity is to be kept as small as possible. Furthermore, the danger always prevails in the case of a yarn breakage, that the strand of fibres 26, instead of following the corrent path into the suction nozzle 13, laps up about one or both delivery rolls 6, 7 in such a manner that there exists the acute, initially mentioned danger of damage to the drafting arrangement.

The scanning or monitoring apparatus 27 travelling along the ring spinning machine comprises a supporting structure 28 which is supported by means of the lower rolls or wheels 29 upon the floor and by means of the upper rolls or wheels 30 upon a longitudinal support member of the machine, for instance, upon the spindle rail 12. The upper rolls 30 perform a guide or guiding function in the longitudinal direction of the machine. The scanning or monitoring apparatus 27 also could be guided at its upper portion by the creel arrangement (not shown) of the ring spinning machine, inasmuch as the type of guide arrangement for the apparatus 27 is of subordinate importance. Furthermore, the scanning apparatus 27 is equipped with standard and thus not particularly shown drive means and centering means, by means of which it is driven for travelling along the ring spinning machine and can be stopped in front of any spinning position in a predetermined operating position.

Upon the scanning apparatus 27 there are arranged the following devices:

(a) A yarn feeler 31 composed of a light beam or ray emitter/receiver-system 32, 33. The light beam 34 emitted from the light emitter or transmitter 32 is reflected by the correctly spun yarn 23 and received by the light receiver 33. If the working conditions at the spinning position are normal, the light receiver 33, via the line or conductor 35, thus transmits a certain signal to control device 36.

As the yarn feeler 31 there can, of course, not only be used the conventional optical feeler or sensor system as herein described, but there can be employed all known detecting methods, for instance, mechanical feeler means, temperature feeler means, traveler feeler means and so forth.

Also, it is of no consequence at which point along its path of movement the yarn is detected or scanned. Thus, it is quite possible to detect the yarn at the balloon 24.

(b) A fibre stream deflecting device, by means of which the fibre stream which is present, in case of a yarn breakage, between the delivery rolls 6, 7 and the broken yarn suction nozzle 13, i.e. the strand 26 of the fibres which is not spun-in (FIG. 2), is deflected from its normal travel path, —wherein this deflection, according to the invention, is effected by shifting the broken thread suction nozzle 13 from its normal working position C into a scanning position D—. In the embodiment according to FIGS. 1 and 1*a*, the fibre stream deflecting device comprises a lever 37 pivotably supported in the scanning apparatus 27. Lever 37 is pivoted by using, for instance, a belt drive system containing a driven belt pulley 38, a belt 39, driving belt pulley 40 and a drive motor 41, from an idling position A, indicated in FIG. 1 with solid or full lines, into a working position B indicated with broken lines. During the course of this pivoting movement the lever 37 contacts the extension 18 of the suction tube 15 of the relevant spinning position at which the scanning apparatus 27 has been stopped. Consequently, the extension 18 including the suction tube 15, in other words the broken yarn suction nozzle 13, are lowered from the normal working position C, shown in FIG. 1 with solid or full lines, into the scanning position D, which is sufficiently spaced from the bottom delivery roll 7 for contact-free or contactless detection of the fibre stream.

Figure 3:
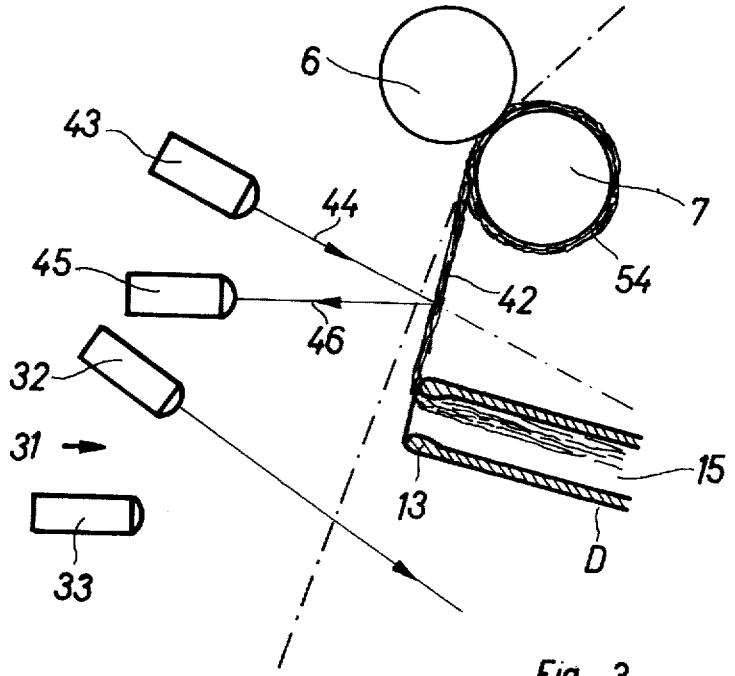
FIG. 3 is the same view as shown in FIG. 2, but with a broken yarn and during the operation of the scanning apparatus.

(c) A contact-free or contactless feeler, consisting of a second beam source or source of rays, e.g. a light emitter or transmitter 43, the beam 44 (see FIG. 3) of which is aimed at the deflected fibre stream 42, and a beam or ray receiver, e.g. a light receiver 45, which receives the beam influenced by the deflected fibre stream 42, e.g. the light beam 46 (see FIG. 3).

(d) An actuation or activating device 47 for the roving supply interrupting device 19 provided at each spinning position which, in the embodiment according to FIG. 1, consists of a slide or baffle 49 guided in a direction transverse to the direction of movement of the roving 2 and driven by a drive motor 48. The displaced slide or baffle 49 moves the activating rod 22, and thus, in turn, interrupts the roving supply to the drafting arrangement 3 by shifting the closure baffle or slide 21 or equivalent structure.

These devices are connected via suitable supply and control lines with the control device 36, which contains the circuit required for the corresponding control functions.

The operation of the scanning apparatus 27 will be explained more fully hereinafter with reference to FIGS. 2 and 3, in which the scanning zone of the fibre stream is shown on an enlarged scale in relation to FIG. 1. In the case of yarn being spun correctly (FIG. 2) the yarn feeler 31 detects the presence of the yarn 23; the scanning apparatus 27 in this case is not stopped, rather moves on to the next spinning position.

Figure 2:
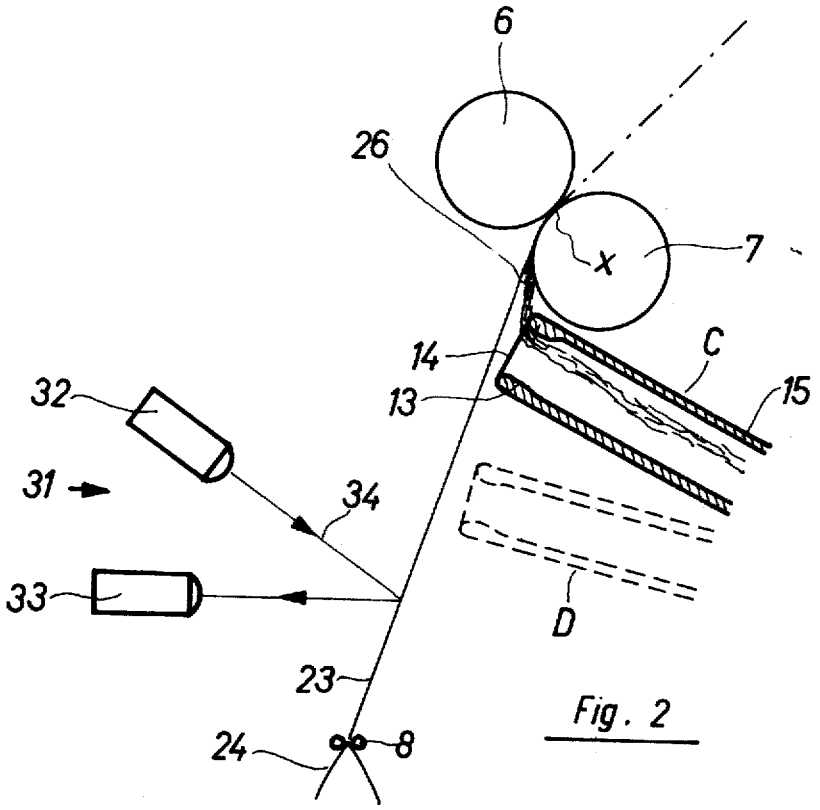
FIG. 2 is a schematic view of the zone of a spinning position of the ring spinning machine whre scanning of the correctly running yarn is performed by the scanning apparatus.

In FIG. 2 there is also indicated the situation where a yarn breakage has occurred at the spinning position. In this case no yarn 23 moves from the nip line x of the delivery rolls 6, 7 to the broken yarn suction nozzle 13 positioned in its normal working position C, rather a fibre stream 26, in the form of a strand of fibres, moves into the broken yarn suction nozzle 13. In this case no danger of damage to the spinning position prevails, and piecing the yarn (by hand or automatically, if, e.g. the scanning apparatus 27 itself is equipped with the automatic piecing means, not shown, for effecting this function, or if a further automatic device built especially for this purpose is provided) can be effected without obstacles.

Furthermore, in FIG. 2, the deflected scanning position D, according to the invention, of the broken yarn suction nozzle 13 is indicated with broken or phantom lines, which corresponds to the position of the nozzle 13 shown in full lines in FIG. 3.

Now in FIG. 3 there is shown the arrangement according to FIG. 2 with the broken yarn suction nozzle 13 in its lowered position, i.e. the case where a yarn breakage has occurred at the spinning position (the position of a normally running yarn being indicated with dash-dotted lines) and wherein the broken yarn suction nozzle 13 has been lowered by the inventive scanning apparatus 27 from its working position C into its scanning position D. There is thus formed an elongated or extended fibre stream 42 between the bottom delivery roll 7 and the lowered nozzle 13, which fibre stream 42 is scanned by the light beam 44 of the light emitter 43. In FIG. 3 the light beam which has not been reflected is indicated with dash-dotted lines as the extension of the light beam 44. The non-reflected portion of the light beam is directed into the empty space behind the scanning zone, where there is no possibility for it to exert any influence, and particularly no possibility of reflexion, even by the surface of a possible lap-up 54 build-up on the bottom delivery roll 7. The lowering of the broken yarn suction nozzle 13 and the scanning of the strand of fibres using the transmitted light beam 44, while the nozzle 13 is in its lowered position, thus creates the conditions for optimum operational reliability of the scanning apparatus.

Figures 4, 4A:
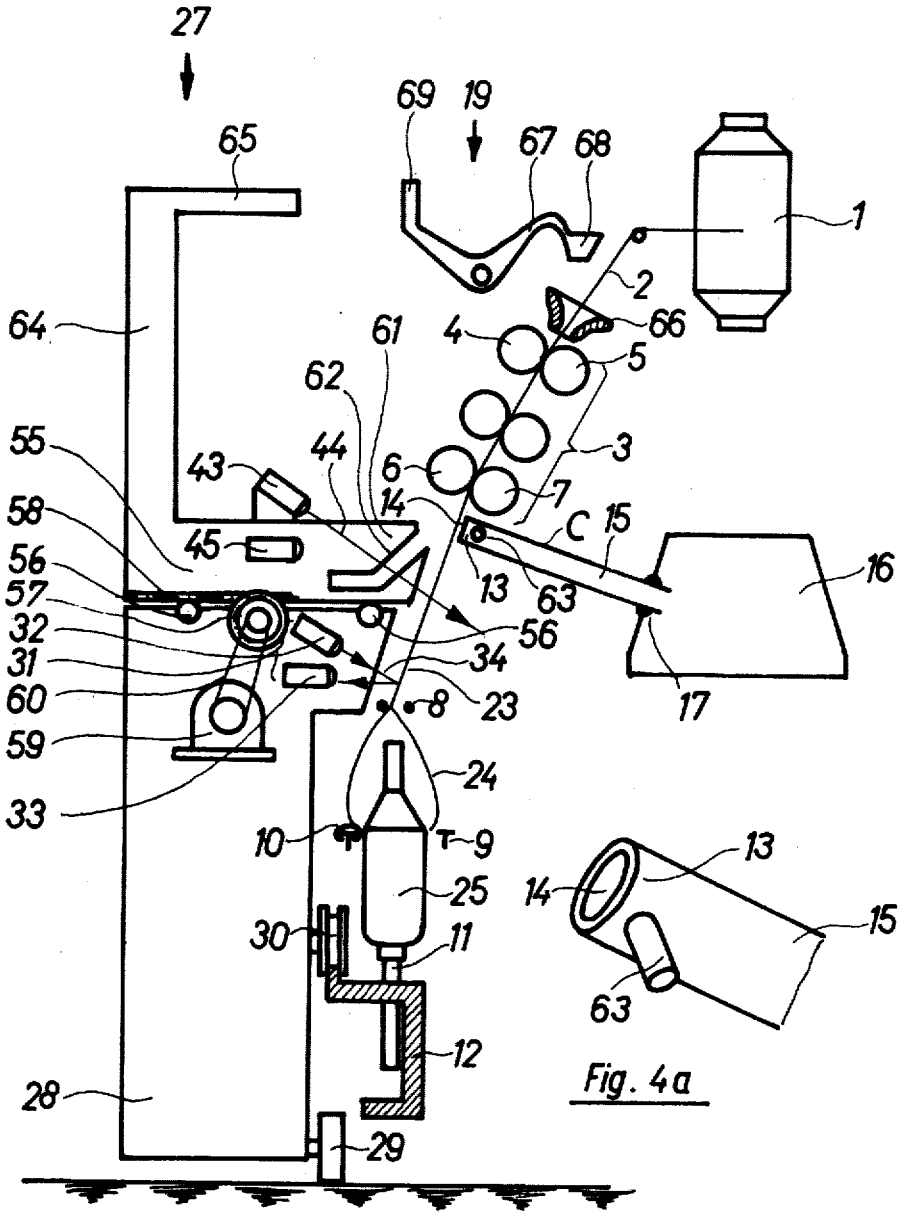
FIG. 4 is an alternative design of the scanning apparatus in a simplified and schematic view similar to the showing of FIG. 1.
FIG. 4*a* illustrates a detail according to FIG. 4 in an enlarged, axonometric view.
Figure 5:
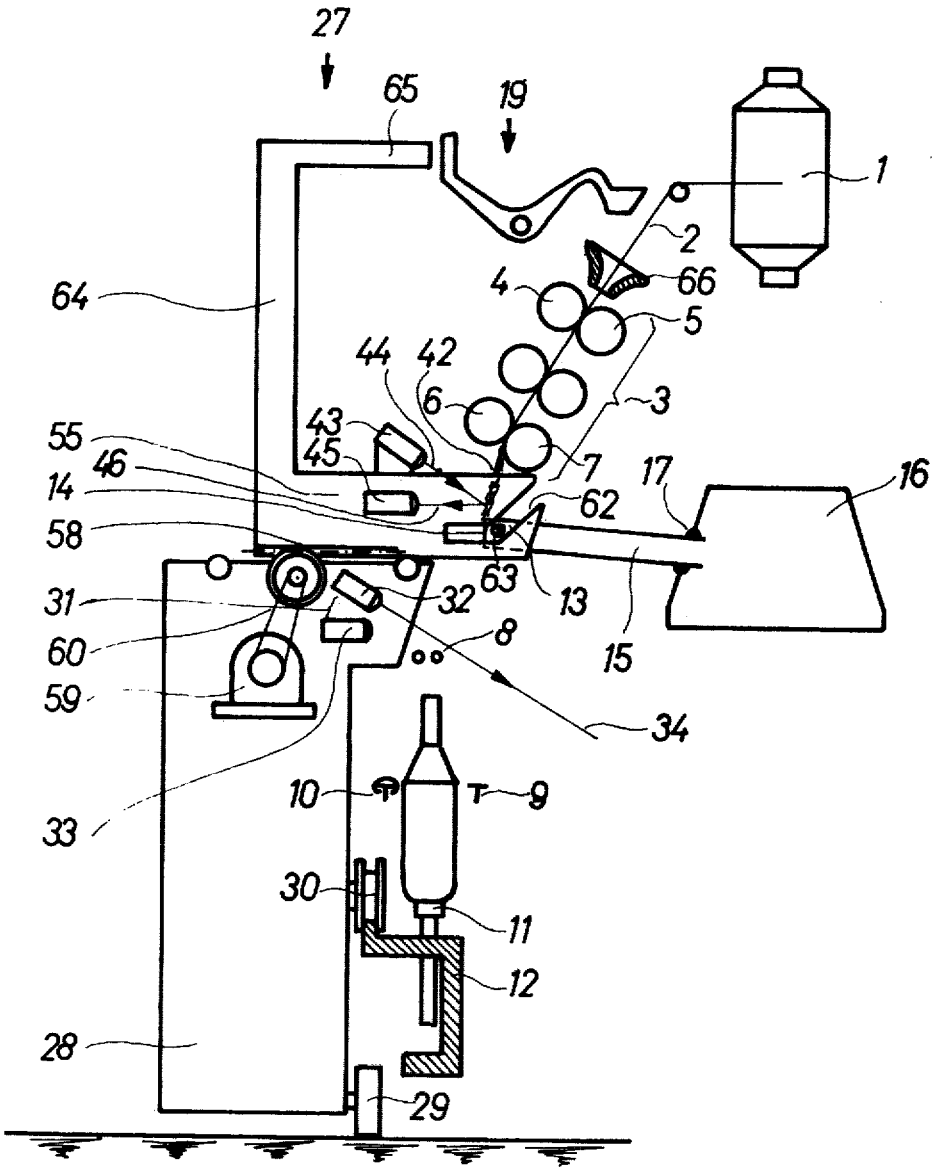
FIG. 5 illustrates the scanning apparatus according to FIG. 4 during the first phase of its activity.
Figure 6:
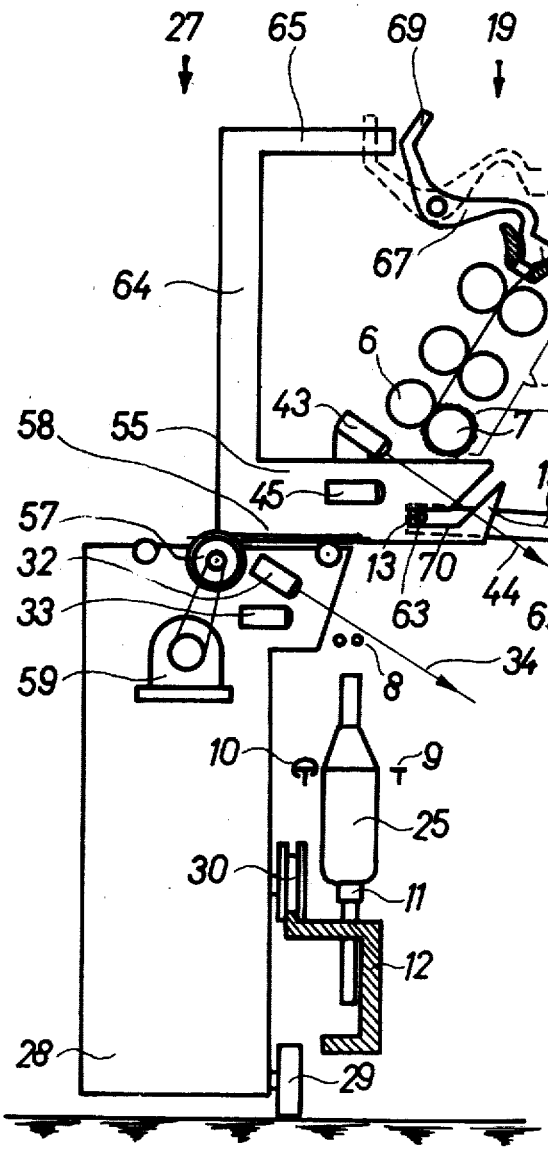
FIG. 6 illustrates the scanning apparatus according to FIG. 4 during the second phase of its activity.

In FIGS. 4 through 6 there has been illustrated an alternative design example of a scanning apparatus during different phases of its activity or action at a spinning position. The same or analogous elements shown in FIG. 1 have been here conveniently designated with the same reference characters.

This modified embodiment differs from the one according to FIGS. 1 and 1*a* in that, here the fibre stream deflecting device comprises a sliding member or slide 55 guided to be movable in the scanning apparatus or device 27 transverse to the travelling direction of the scanning apparatus 27. The sliding member 55 is guided by rolls 56, and by using for instance a gear 57 and a toothed rack 58 meshing therewith such sliding member 55 can be driven by a drive motor 59, for instance via a chain drive 60. The drive motor 59 is controlled by appropriate control means in such a manner that the sliding member 55 can be stopped at predetermined positions relative to the supporting structure 28.

The sliding member 55 is provided with a front portion 61 facing the spinning positions of the ring spinning machine. At this front portion 61 there is provided a guide slot 62. If the sliding member 55 is moved toward the related spinning position, a cam or dog 63 (see also FIG. 4*a*), mounted on the suction tube 15 in the vicinity of the orifice or mouth 14 of the broken yarn suction device 13, is inserted into the guide slot 62.

Furthermore, there are mounted on the sliding member 55 the beam or ray source 43 and the receiver 45 of the second feeler, which, for instance, detects reflection, and also the actuation or activating device of the roving supply interrupting device 19. In this case, the actuation device is in the form of an upwardly directed extension 64 provided with a plunger 65. The relative position of the guide slot 62, the elements 43, 45 of the second feeler and the plunger or pusher 65, in this arrangement, are chosen such that these elements, during the transverse movement of the sliding member 55 toward the spinning position, are activated at the right moment and in their correct position, respectively.

As the roving supply interuppting device 19 in the embodiment here shown, there can be used a known device containing a funnel or trumpet 66 and a tilting or pivotal lever 67. The tilting lever 67 is provided at one of its ends with a body member or stopper 68, the shape of which is complementary to the interior of the funnel 66, and at its other end is provided with an extension 69. In this arrangement the extension 69, in the idling position of the tilting or pivotal lever 67, is in a position where it can come into contact with the plunger 65 during the lateral movement of the latter, and specifically in such a manner that the tilting lever 67 is tilted in clockwise direction and the body or stopper 68 closes the funnel 66. The roving 2 is then clamped between the funnel 66 and the body 68, and thus, is severed between the funnel 66 and the take-in rolls 4, 5, i.e. the roving supply is interrupted.

In FIG. 4 a spinning position is shown where the yarn 23 is spun in normal manner: the yarn feeler 31 detects the presence of a yarn and the scanning apparatus 27 moves on along the ring spinning machine.

In FIG. 5, on the other hand, there has been shown the occurrence of a yarn breakage. In this situation the light beam 34 from the light emitter 32 is not reflected, so that by means of the light receiver 33 a corresponding signal is transmitted to the control device 36, not shown in FIG. 5 but portrayed in FIG. 1. In this case the scanning apparatus 27 stops, and the control device 36 appropriately activates the drive motor 59. Now the sliding member 55 is moved toward the corresponding spinning position. During this process first the cam 63 of the broken yarn suction nozzle 13 is inserted into the guide slot 62 of the sliding member or slide 55. The guide slot 62 in this arrangement is inclined, as shown, in the direction of movement of the sliding member 55, towards the rear and downwardly in such a manner that the cam 63 is pivoted down or downwardly cammed as the sliding member 55 continues its movement. Also in this arrangement, like in the one according to FIGS. 1 and 1*a*, a fibre stream 42 is formed between the delivery rolls 6, 7 and the pivoted down nozzle 13. This occurs under the condition that, already before the lowering of the broken yarn suction nozzle 13, there is present a fibre stream which emerges from the nip line x of the rolls 6 and 7. In FIG. 5 the scanning apparatus 27 is shown in a position in which the cam 63 of the broken yarn suction nozzle 13 has reached the lowest point in the guiding slot 62, i.e. where the suction nozzle 13 has reached its maximum distance from its working position, and thus, where there is present an elongated fibre stream 42. This position corresponds to the scanning position D of the broken yarn suction nozzle 13, in which the drive motor 59 is stopped by any suitable means, such as for instance a standard switch. Furthermore, in the embodiment according to FIGS. 4 through 6, the mounting of the light emitter 43 and the light receiver 45 of the second feeler also is undertaken on the sliding member 55, and specifically in such a mutual relative position that the light beam 44 emitted by the light emitter 43 is reflected from the fibre stream 42, in the form of a reflected light beam 46, to the light receiver 45 just as the sliding member 55 is in the position shown in FIG. 5.

If a fibre stream or bundle 42 is present, the light receiver 45 receives a light beam 46, and thus transmits a signal to the control device, signalling that at the relevant spinning position a yarn breakage has occurred and that the fibre material not spun-in is flowing correctly into the broken yarn suction nozzle 13. This signifies that lap-up formation is not present.

The control device now will restart the reversible drive motor 59 in reverse direction, i.e. the sliding member 55 moves back into its idling or rest position shown in FIG. 4, and the broken yarn suction nozzle 13 thus is brought back into its normal working position.

Whether the scanning apparatus 27 moves, for instance, on to a next spinning position, or if a spinning start-up operation is performed first (for which spinning start-up conventional elements, not shown, are required on the scanning apparatus 27), does not concern the present invention, and a detailed description of this procedure thus can be dispensed with.

The advantage of the here shown mounting of the second feeler 43, 45 on the sliding member 55 resides in the fact that this feeler 43, 45 thus automatically can become active only in the scanning position D of the broken yarn suction nozzle 13, since only in this position of the sliding member 55 is there possible at all a reflection of the light beam 44 to the light receiver 45. This increases the operational reliability and the decisiveness of the signal transmitted by the second feeler 43, 45.

In FIG. 6, on the other hand, there is illustrated what happens if the light beam 44, when the sliding member 55 is in the position according to FIG. 5, is not reflected by a fibre stream 42, i.e. if (at a high degree of probability) the fibres lap-up about a delivery roll, for instance, about the bottom delivery roll 7, in the form of a fibre lap-up 54, such that there exists an acute danger of damage to the drafting arrangement 3.

In this case the light receiver 45 cannot detect any reflected light beam. The control device is structured such that the drive motor 59 is restarted again, but is rotated in the same direction as before, i.e. in the sense of a further approach of the sliding member 55 to the spinning position. During this process the broken yarn suction nozzle 13 is practically not moved any further from its scanning position, as the guide slot 62 is provided with a section 70 extending parallel to this direction of movement of the sliding member 55. Owing to the further movement of the sliding member 55 toward the spinning machine, the plunger or pusher 65 activates the roving supply interrupting device 19, i.e. the supply of the roving 2 to the drafting arrangement 3 is interrupted. This is effected in the modified embodiment according to FIGS. 4 through 6 in that, the tilting or pivotal lever 67 is tilted from its idling position, indicated in FIG. 6 with broken or phantom lines, by the plunger 65, in such a manner that the body or stopper 68 fills-up the funnel 66 and severs the roving 2 by clamping it in the funnel 66. The dangerous further build-up of the fibre lap-up 54 thus is advantageously interrupted, since no further fibre material is transferred into the drafting arrangement 3. With this operation mode the manner in which the roving supply interrupting device 19 is constructed is not crucial; it is merely important that the interruption device can be activated by the plunger 65 or the like of the sliding member 55.

The embodiment shown in FIGS. 4 through 6 shows the advantage of simplicity, since all checking functions of the scanning apparatus 27 can be performed by moving one single element, namely the sliding member 55, a suitable control device ensuring that the movement of the sliding member 55 can be effected as explained above in detail, in two phases.

Figure 7:
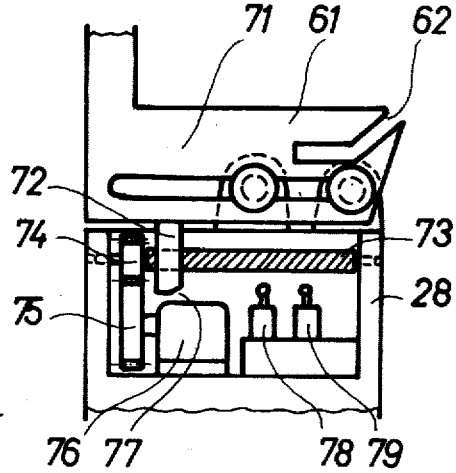
FIG. 7 illustrates a portion of an alternative embodiment of a scanning apparatus analogous to the view shown in FIG. 4.

In FIG. 7 there is illustrated an alternative design example of a detail of a scanning apparatus according to FIG. 4, in which the two-phase movement of the sliding member 71, which also is provided with a guiding or guide slot 62, is effected by a spindle drive instead of by a toothed rack or rail. In this case the sliding member 71 is rigidly connected with a carrier or entrainment member 72, which contains a threaded bore for taking up a threaded shaft or spindle 73 supported in the supporting structure 28. The threaded shaft 73 is connected with a reversible drive motor 76 via a pair of gears 74, 76. The inclined or beveled edge 77 of the carrier or entrainment member 72 at the same time serves as switching cam means for two switches 78 and 79 arranged along the path of movement, which switches 78, 79 are connected electrically via lines or conductors with the here not shown control device. As the first switch 78 is activated, the sliding member 71 is stopped in its scanning position D described above. Depending on whether a fibre stream 42 (FIG. 5) is present or not, the drive motor 76 either is reversed by the control device and is restarted, such that the sliding member 71 moves back to its idling position, or is restarted in the same direction again, until the second switch 79 also is activated. In this position, the roving supply interrupting device 19 is activated and the drive motor 76 is reversed, such that the sliding member 71 moves back to its idling position.

Instead of the described second feeler, working using the principles of reflection, of course also other types of feelers are employable, such as, for instance, feelers in which influencing of the light beam emitted from the beam or ray source by the deflected fibre stream is effected by absorption of the light beam.

While there are shown and described present preferred embodiments of the invention, it is to be distinctly understood that the invention is not limited thereto, but may be otherwise variously embodied and practised within the scope of the following claims. Accordingly,

What I claim is:

1. A travelling scanning apparatus for successively monitoring the working conditions at each spinning position of a ring spinning machine with respect to yarn breakages and lap-up formations on drafting arrangement rolls to which there is infed roving from a roving supply, comprising:

a first yarn feeler for checking, without contacting the yarn, the presence of a yarn between delivery rolls of the drafting arrangement and a spindle;

a second yarn feeler which, in the event a yarn breakage is detected, checks for the presence of a fibre stream between the delivery rolls of the drafting arrangement and a broken yarn suction nozzle;

a broken yarn suction nozzle arranged directly below the bottom delivery roll in its normal working position and movable into a scanning position;

a fibre stream deflecting device for deflecting the fibre stream such that said fibre stream can be acted upon by said broken yarn suction nozzle;

an interrupting device for interrupting the roving supply provided at each spinning position of the ring spinning machine;

an actuation device for activating, in the event of absence of the fibre stream, said interrupting device for interrupting the roving supply;

said fibre stream deflecting device, when activated by the scanning apparatus, lowering the broken yarn suction nozzle from its normal working position into said scanning position which is sufficiently lowered from the bottom delivery roll for the contactless detection of the fibre stream by said second yarn feeler; and said second yarn feeler comprising beam source means for emitting a beam onto the deflected fibre stream and beam receiver means for receiving a beam influenced by the deflected stream of fibres.

2. The travelling scanning apparatus as defined in claim 1, wherein:

said fibre stream deflecting device comprising a sliding member;

means for slidably guiding said sliding member in a direction transverse to a predetermined direction of travel of the scanning apparatus;

said sliding member having a front part which faces the spinning positions of the ring spinning machine;

said front part being provided with a guiding slot;

a cam fixedly connected with the broken yarn suction nozzle and capable of protruding into said guiding slot during the transverse movement of said sliding member; and said guiding slot being configured such that owing to any further transverse movement of the sliding member said broken yarn suction nozzle together with said cam are shifted from their normal working position into said scanning position.

3. The travelling scanning apparatus as defined in claim 2, wherein:

said second yarn feeler is mounted on said sliding member.

4. The travelling scanning apparatus as defined in claim 3, wherein:

said actuation device is mounted on said sliding member; and actuation of the roving supply interrupting device of the relevant spinning position only being effectuated after the scanning position of the broken yarn suction nozzle has been reached by the performance of a continuing transverse movement of the sliding member.

5. The travelling scanning apparatus as defined in claim 4, further including:

means for moving the sliding member in a first phase to such an extent that the broken yarn suction nozzle is shifted from its normal working position into the scanning position; and said moving means moving the sliding member during a second phase such that actuation of the roving supply interrupting device is effected.

6. The travelling scanning apparatus as defined in claim 2, further including:

control means for the transverse movement of the sliding member; and said control means effectuating a second phase of movement of the sliding member when the second yarn feeler detects absence of a fibre stream between the delivery rolls of the drafting arrangement and the broken yarn suction nozzle.

7. A travelling scanning apparatus for successively monitoring the working conditions at each spinning position of a ring spinning machine with respect to yarn breakages and lap-up formations on drafting arrangement rolls to which there is infed roving from a roving supply, comprising:

a first yarn feeler for checking the presence of a yarn between delivery rolls of the drafting arrangement and a spindle;

a second yarn feeler which, in the event a yarn breakage is detected, checks for the presence of a fibre stream between the delivery rolls of the drafting arrangement and a broken yarn suction nozzle;

a broken yarn suction nozzle arranged below the delivery rolls in a normal working position and movable into a scanning position;

a fibre stream deflecting device for deflecting the fibre stream such that said fibre stream can be acted upon by said broken yarn suction nozzle;

an interrupting device for interrupting the roving supply provided at each spinning position of the ring spinning machine;

an actuation device for activating, in the event of absence of the fibre stream, said interrupting device for interrupting the roving supply;

said fibre stream deflecting device serving for the lowering of the broken yarn suction nozzle from its normal working position into said scanning position which is sufficiently lowered from the delivery rolls of the drafting arrangement for the detection of the fibre stream by said second yarn feeler; and said second yarn feeler comprising means for emitting a beam onto the deflected fibre stream and receiver means for receiving a beam influenced by the deflected stream of fibres.

8. A ring spinning machine comprising:

delivery means for delivering roving to a spinning position;

receiving means for receiving roving in the event of a fault; and means mounting said receiving means to be movable between a first position adjacent the delivery means and a second position relatively spaced therefrom.

9. The ring spinning machine as defined in claim 8, further including:

sensor means for sensing the presence of roving between said delivery means and said receiving means when said receiving means assumes said second position.

10. The ring spinning machine as defined in claim 9, further including:

a travelling device capable of servicing a plurality of spinning positions and upon which there is arranged said sensor means.

11. The ring spinning machine as defined in claim 8, wherein:

said receiving means comprises a suction device.

12. The ring spinning machine as defined in claim 8, further including:

means for initiating movement of said receiving means from said first position to said second position after a fault has been detected.

* * * * *